US007500508B2

(12) United States Patent
Heinrich et al.

(10) Patent No.: US 7,500,508 B2
(45) Date of Patent: Mar. 10, 2009

(54) INJECTION-MOLDING DEVICE FOR MANUFACTURING V-ENGINE BLOCKS

(75) Inventors: Siegfried Heinrich, Laichingen (DE); Sascha Padovan, St. Gallen (CH); Ulrich Binder, Uzwil (CH); Benno Niedermann, Niederglatt (CH)

(73) Assignee: Buhler Druckguss AG, Uzwil (CH)

( * ) Notice: Subject to any disclaimer, the term of this patent is extended or adjusted under 35 U.S.C. 154(b) by 0 days.

(21) Appl. No.: 11/330,889

(22) Filed: Jan. 12, 2006

(65) Prior Publication Data

US 2007/0006988 A1 Jan. 11, 2007

(30) Foreign Application Priority Data

Jul. 8, 2005 (DE) ..... 10 2005 032 330

(51) Int. Cl.
*B22D 17/26* (2006.01)
*B22D 33/04* (2006.01)

(52) U.S. Cl. ..... 164/312; 164/341

(58) Field of Classification Search ..... 164/312, 164/113, 137, 341
See application file for complete search history.

(56) References Cited

U.S. PATENT DOCUMENTS 3,596,708 A * 8/1971 Lapin ..... 164/347
5,865,241 A * 2/1999 Bishenden et al. ..... 164/137
6,761,208 B2 * 7/2004 Whealy et al. ..... 164/340

* cited by examiner

*Primary Examiner*—Kevin P Kerns
(74) *Attorney, Agent, or Firm*—Merchant & Gould P.C.

(57) ABSTRACT

An injection-molding device is for manufacturing V-engine blocks, in particular an injection-molding machine with a fixed and moving mold half, wherein the moving mold frame contains sliders and ejectors, along with center sleeve sliders angularly arranged relative to each other and a supporting plate for locking the center sleeve slider. Therefore, the force is introduced perpendicular via the center sleeve sliders, and absorbed via the supporting plate or moving identification plate. The moving mold half is secured on a mounting frame.

11 Claims, 2 Drawing Sheets

INJECTION-MOLDING DEVICE FOR MANUFACTURING V-ENGINE BLOCKS

BACKGROUND OF THE INVENTION

The invention relates to an injection-molding device for manufacturing V-engine blocks for combustion engines. In particular, the injection-molding device is an injectionmolding machine with the corresponding mold.

U.S. Pat. No. 5,865,241 discloses an injection-molding machine for manufacturing V-engine blocks in a mold with a fixed and moving mold half. In addition to the mold cavity, the moving mold half encompasses a column-guided ejector unit. A mounting plate accommodates an ejector box that can be lifted from it by means of a dual-action cylinder. The cylinder extends over the side of the mounting plate facing away from the mold.

Additional cylinders used for inserting and removing sliders are bilaterally situated perpendicular to this cylinder at the level of the mold cavity.

The ejector box is a massive plate that occupies a portion of the initially mentioned cylinder, and has a trapezoidal cross-section. The inclined lateral walls situated at an identical angle to the V-position of the engine block also each accommodate a dual-action ejector cylinder with inserts for the engine cylinder, the imagined elongated axes intersect in the mold cavity. Securing these cylinders on the inclines actuates horizontal and vertical force components on the ejector box during ejection.

Other cylinders are required for opening and closing the mold.

WO 2004/033131 describes a similar mold and injection-molding machine, in which two additional hydraulic cylinders are provided for shifting the moving mold halves. This cylinder arrangement also distinctly projects over the side of the moving mold half facing away from the mold.

The described molds are structurally complex, so that very large masses have to be moved in the injection-molding machine.

SUMMARY OF THE INVENTION

An object of the invention is to develop an injection-molding device for manufacturing V-engine blocks that make it possible to avoid the disadvantages of prior art, and in particular enable a stable mounting system given a distinctly lower overall height and mass of the mold. This object is achieved with the features of the patent claim.

In this case, the entire projected bursting surface of the center sleeve sliders is coved by the locking surface of these sliders. The arising forces are completely absorbed by the supporting plate or mounting plate without any forth generation. The center sleeve sliders are only supported in the mounting plate, but not connected with the latter. In addition, the ejection device for expelling the cast section is integrated in the mold plate. The mold-mounting unit is integrated in the mounting frame.

Preferred embodiments are disclosed in the subclaims.

The injection-molding device according to the invention enables a stable mounting of the mold while reducing the mass and overall height by at least 20%. It is modular and can be used for all types of V-blocks.

BRIEF DESCRIPTION OF THE DRAWINGS

The invention will be described in greater detail below in an exemplary embodiment based on a drawing. The drawing shows.

DETAILED DESCRIPTION OF THE PREFERRED EMBODIMENTS

Figure 1:
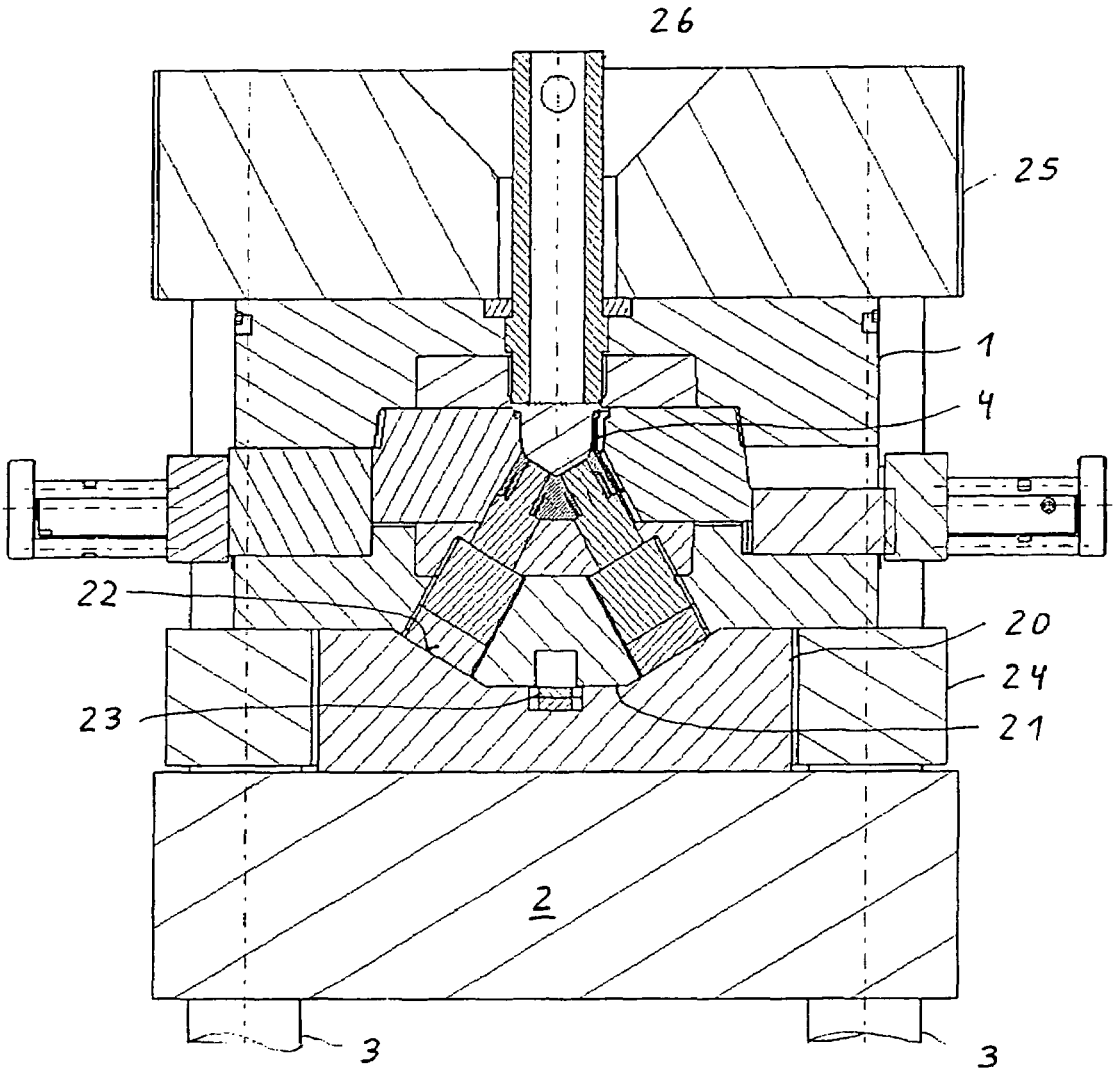
FIG. 1: a closed mold.
Figure 2:
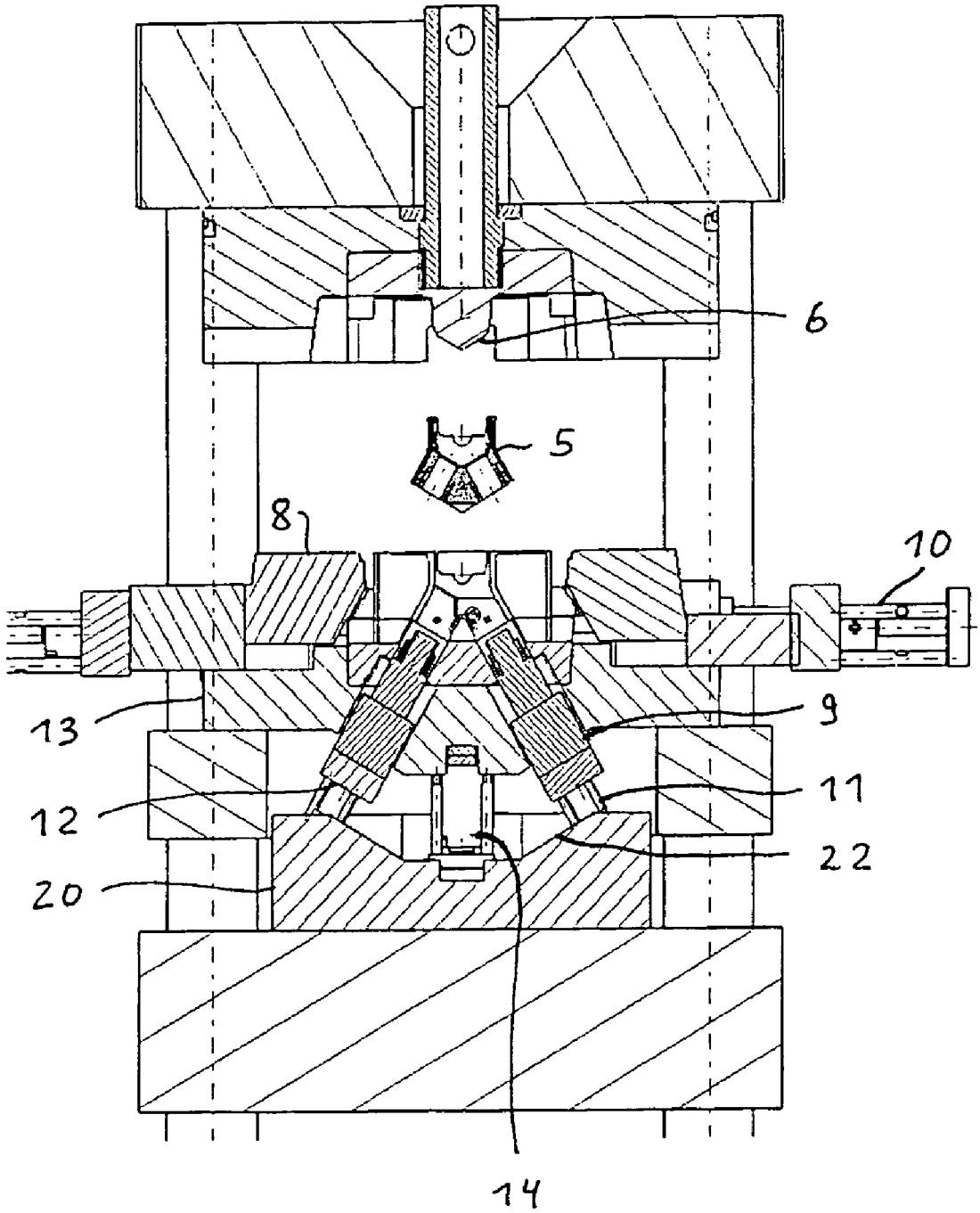
FIG. 2: an open mold with ejected V-block

An injection-molding device, an injection-molding machine for manufacturing V6N8N10N12 engine blocks 5 in the example (not explicitly shown), contains a fixed mold half 1 and a moving mold half 13, wherein the moving mold half 13 is mounted on a moving and guided mounting frame 24. The mold cavity 4 for the V-engine block 5 is bordered by an insert 6 in the fixed mold half 1, an insert 7 in the moving mold half 13, as well as lateral sliders 8 and center sleeve sliders 9, wherein the latter angularly correspond to the V-shape of the engine block. The sliders 8 or center sleeve sliders 9 are actuated by 2-way hydraulic cylinders 10, 11.

The sliders 8 can be used to minimize changes in location and position owing to casting technique. As disclosed in DE 101 28874 A 1, this is achieved by providing surfaces for locking a slider 8 and additional surfaces for the combined counter-locking and mold centering on mold frames 13 along with molded parts or sliders 8.

A supporting plate 20 with an angular depression 21 is arranged between the insert 7 and the moving identification plate 2, wherein the angle of the lateral wall 22 corresponds to the V-angle of the V-engine block 5. With the mold closed according to FIG. 1, the center sleeve sliders 9 abut the lateral wall 22 via supports 12. Therefore, force is introduced perpendicular to the lateral wall 22, ensuring a stable mounting of the mold. By contrast, the center sleeve sliders 9 are only supported against the insert 7 or the moving mold frame 13 given an open mold. The latter case involves no rigid connection to the supporting plate 20. The mold frame 13 also contains ejection cylinders 14, which are incorporated in a recess 23 of the supporting plate 20 with the mold closed.

The supporting frame 24 is only connected with the moving identification plate 2 via tappet rods.

By comparison to a conventional mold, a more stable mounting of the center sleeve slider 9 is achieved without any fragmentation of the bursting forces. The projected bursting surface of the center sleeve sliders 9 is covered by their locking surface (sup port 12). This design makes it possible to dismantle and assemble the center sleeve sliders directly on the injection-molding machine.

In conjunction with the arrangement of the ejection cylinder 14, this enables a reduction in overall mold height to approx. 1.5 m, and a reduction in mold weight by approximately 20%.

The moving mold frame 13 is guided laterally in the machine chassis. The casting chamber 26 is secured in the fixed mold half 1, and situated in the fixed identification plate 25 without contacting it.

The casting mold can expand on the X and Y axis, and centered on the mold support and machine base plate. When the casting mold is heated, no additional loads are hence placed on the guiding paths of the machine. After the casting mold has reached the operating temperature, the casting unit is aligned relative to the casting mold.

In this way, a fixed identification plate 25 and the moving identification plate 2 exhibit a more stable structure, and have fewer boreholes and cut-outs, i.e., a lower plate bow as well. This imparts a better dimensional stability to the cast parts.

REFERENCE LIST

1 Fixed mold half

2 Moving identification plate

3 Column
4 Mold Cavity
5 V-engine block
6 Mold insert, fixed side
7 Mold insert, moving side
8 Slider
9 Center sleeve slider
10 Hydraulic cylinder
11 Hydraulic cylinder
12 Support
13 Mold frame, moving side
14 Ejection cylinder
20 Supporting plate
21 Depression
22 Support surface
23 Recess
24 Mounting frame
25 Fixed identification plate
26 Casting chamber

What is claimed:

1. An injection-molding device for manufacturing V-engine blocks, comprising:

an injection mold comprising:

a fixed mold section; and a moving mold section comprising sliders and ejectors, center sleeve sliders angularly arranged relative to each other, each center sleeve slider having an axis;

a supporting plate for supporting lower ends of the center sleeve sliders;

a centrally guided moving mounting frame;

wherein the center sleeve sliders are entirely supported on the supporting plate in the direction of force directed along the axis of each center sleeve slider, wherein the supporting plate comprises a supporting surface arranged perpendicular to the axis of each of the center sleeve sliders supporting the lower end of each of the center sleeve sliders, and wherein the moving mold section is secured to the centrally guided, moving mounting frame, and wherein the supporting plate and a supporting frame are connected to the injection mold.

2. The injection-molding device according to claim 1, wherein an active bursting force of the center sleeve slider is directly absorbed in the supporting plate.

3. The injection-molding device according to claim 2, wherein the center sleeve sliders are only supported against the supporting surfaces with the mold mounted.

4. The injection-molding device according to claim 2, further comprising an ejection cylinder, wherein the supporting plate defines a recess and wherein the ejection cylinder is received in the recess.

5. The injection-molding device according to claim 1, wherein the moving mold section moves along a direction of travel and wherein the supporting surfaces are at an oblique angle to the direction of travel.

6. The injection-molding device according to claim 1, wherein the moving mold section comprises an inseparable unitary moving assembly.

7. The injection-molding device according to claim 1, wherein the lower ends of the central sleeve sliders slidably engage the supporting surfaces and remain on the supporting surfaces during opening and closing.

8. The injection-molding device according to claim 1, wherein the injection-molding device separates for ejection into only two portions along a separation line proximate the supporting surfaces.

9. The injection-molding device according to claim 1, wherein the moving mold section defines a depression with lateral walls extending perpendicular to the axes of the associated central sleeve sliders, and wherein the supporting surfaces comprise the lateral walls.

10. An injection-molding device according to claim 1, wherein the supporting frame connects to the injection mold with columns.

11. An injection-molding device for manufacturing V-engine blocks, comprising:

a fixed mold section;

a moving mold section comprising sliders and ejectors, center sleeve sliders angularly arranged relative to each other, each center sleeve slider having an axis, sides extending parallel to the axis and a lower end aligned along the axis and extending perpendicular to the axis; and a supporting plate for supporting lower ends of the center sleeve sliders and having a supporting surface perpendicular to the axis of each of the center sleeve sliders;

wherein the center sleeve sliders are entirely supported on the supporting plate in the direction of force directed along the axis of each center sleeve slider, wherein the supporting plate comprises a supporting surface supporting the lower end of each of the center sleeve sliders, and wherein the moving mold section is secured to a centrally guided, moving mounting frame.

* * * * *